United States Patent [19]

Görike

[11] Patent Number: 4,809,811

[45] Date of Patent: Mar. 7, 1989

[54] EAR PAD CONSTRUCTION FOR EARPHONES

[75] Inventor: Rudolf Görike, Vienna, Austria

[73] Assignee: AKG Akustische u.Kino-Geräte Gesellschaft m.b.H., Austria

[21] Appl. No.: 931,695

[22] Filed: Nov. 14, 1986

[30] Foreign Application Priority Data

Nov. 18, 1985 [AT] Austria ..... 3355/85

[51] Int. Cl.[4] ..... H04R 25/00

[52] U.S. Cl. ..... 181/129; 181/132; 381/183; 381/187

[58] Field of Search ..... 181/129, 132; 381/183, 381/187

[56] References Cited

U.S. PATENT DOCUMENTS

| | | | |
|---|---|---|---|
| 3,117,575 | 1/1964 | Carrell et al. | 181/129 X |
| 3,602,329 | 8/1971 | Bauer et al. | 181/129 |
| 4,005,278 | 1/1977 | Gorike | 381/187 X |
| 4,160,135 | 7/1979 | Gorike | 381/187 X |
| 4,572,324 | 2/1986 | Fidi et al. | 181/129 |

FOREIGN PATENT DOCUMENTS 362433 5/1981 Austria .

*Primary Examiner*—Benjamin R. Fuller
*Attorney, Agent, or Firm*—McGlew and Tuttle

[57] ABSTRACT

An ear pad for earphones comprises a foam-like material formed into a pad enclosing the user's ear in use in order to expand the essentially linear frequency response of a good earphone so that it brings also the lowest still audible frequencies into the linear region, and simultaneously with the expansion of the transmission range of the earphone, to make the reproduction of stereophonic acoustic events more natural. The ear pad is advantageously shaped and made of open-cell elastic foam material having on its inner and/or its outer side or in its interior so as to be disposed in the sound path from the coupling space outward, at least one passive membrane supported for vibration and having a natural resonance which lies in the range of the lower frequencies.

11 Claims, 4 Drawing Sheets

Fig. 1
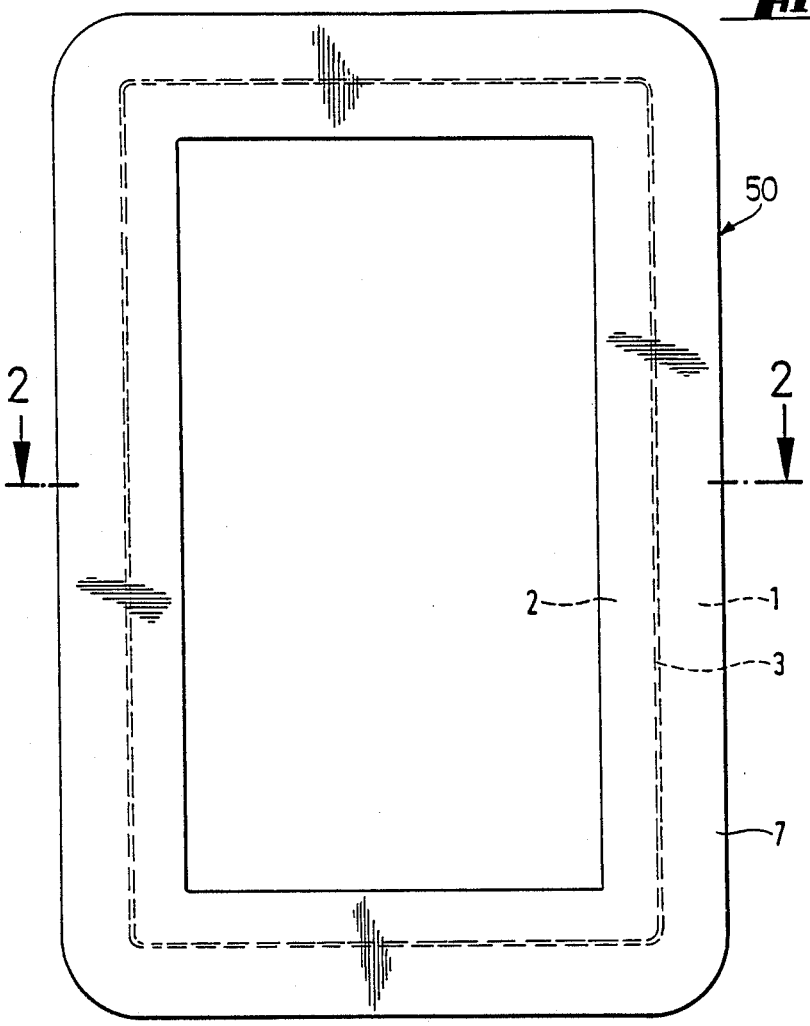
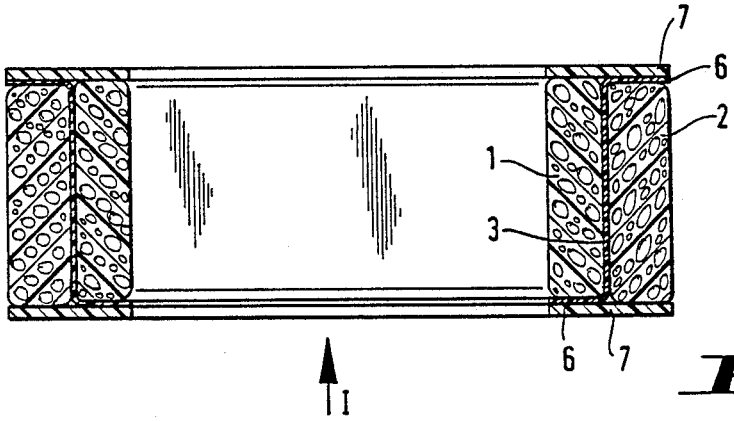
Fig. 2

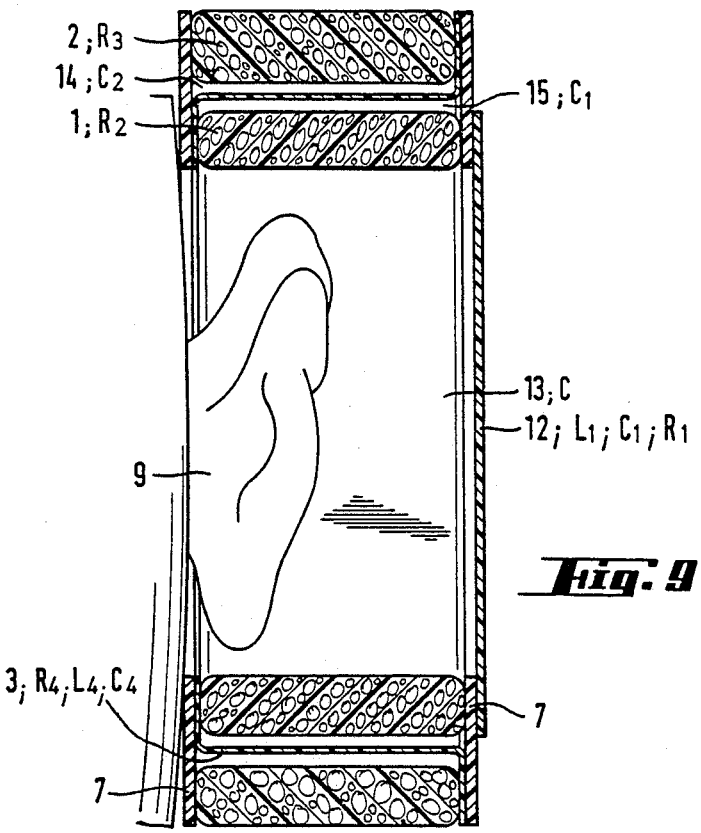
Fig. 9
Fig. 10
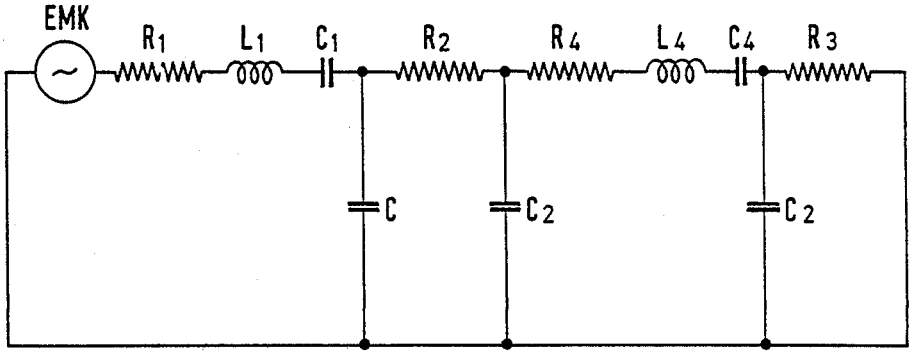

EAR PAD CONSTRUCTION FOR EARPHONES

BACKGROUND OF THE INVENTION

This invention relates in general to sound devices and in particular to a new and useful ear pad construction for earphones, particularly for stereophonic accoustic events.

The invention relates to an ear pad for earphones which in use embraces the user's ear and which comprises a tubularly formed, open-cell elastic foam material.

Similar ear pads are generally known (see e.g. AT-PS No. 362,433) and comprise in some cases coverings of a soft material slightly permeable to sound (e.g. thin leather or the like). Ear pads of this construction are usually used where good shielding against noise occuring outside the earphone is demanded. For the reproduction of acoustic events transmitted stereophonically they are not particularly suitable as their surfaces limiting the coupling space give rise to reflections in the coupling space, whereby the directional and distance hearing required in stereophonic reproduction and also the timbre are adversely affected.

In the so-called open earphones, where sound can emerge from the coupling space almost unhindered, the ear pad usually consists of open-cell elastic foam material of good sound permeability which generally has the form of a disk, and, in use, applies against the ear. From this, due to the good sound permeability of the pad, there necessarily results the effect of acoustic shortcircuit between front and back of the transducer diaphragm, since as a rule the back of the sound-generating diaphragm is not capsulated but radiates into the open without any substantial acoustic resistance. This results in a decline of the frequency response characteristic with decreasing frequency. To counteract this fact, the natural resonance of the sound-generating diaphragm has been moved into the region of the lowest frequencies, but without thereby obtaining a satisfactory result.

Apart from the endeavors to include in the frequency response of a good earphone also the frequencies lying in the lowest audible range into the essentially linear frequency response, the attempt has been made also to achieve compatitility between loudspeaker reproduction and earphone reception. This, however, has not been possible until now, or has at best accomplished only very insufficiently. While it was seen that the type of limitation of the coupling space which forms between the transducer diaphragm and the auditory canal when the earphone is worn is critical, a satisfactory solution has not been found despite this finding. Also the proposal aiming in that direction, of changing over from the free-field-corrected to the diffused-field-corrected earphone yielded only moderate success. In fact, it was not taken into account that it is possible with one ear alone to locate a sound source, especially if it is small (for instance a mosquito flying by) clearly as to direction and distance. The reason for this ability of the human ear is that the reflections on the external ear cause a comb filter effect, which by training leads to a surprising certainty of localization already at an early age, supported by the sense of sight. This effect, in the following referred to as near effect, is also the reason why, with the conventional headphones, compatibility between loudspeaker reception and earphone reception cannot be achieved, and why, therefore, all attempts to suppress the above described effect by influencing the electric signal supplied to the earphone, e.g. by a special form of the frequency response, by transit time delay or by adding reverberation, were doomed.

Proof that such a near effect exists can be furnished by a simple experiment. In fact, if one directs white noise in the form of a flat sound field against the ear from a distance of, for instance, 100 cm, and between the sound generator and the ear one moves an extremely thin, i.e. low-mass, loosely hanging large membrane (foil) a few microns thick toward the ear from a distance of about 30 cm. It is found that at a distance of only 5 cm between ear and membrane a change of timbre of the noise is noticeable, if a slight one. As the membrane is brought closer to the ear, for instance to about 2 cm and less, the change in timbre is quite strong., proving that a near effect exists. The cause of this effect is attributable to the pressure accumulation between the auricle or respectively the external auditory canal and the membrane, from which a disturbance of the aforementioned comb filter effect results.

SUMMARY OF THE INVENTION

From the above statements it is seen that the invention expands the essentially linear frequency response of a good earphone in such a way that it brings into the linear region also the lowest still audible frequencies, while on the other hand it offers the possibility, simultaneously with the expansion of the transmission range of an earphone, to make the reproduction of stereophonic acoustic events more natural than before, i.e. to come close to compatibility between loudspeaker reproduction and earphone reception.

In accordance with the invention, an ear pad is used which is characterized in that on the inner and/or outer side, or in the interior of the pad, in the sound path from the coupling space to the outside, at least one passive membrane is arranged which is adapted for vibration with a natural resonance which lies in the range of the lower frequencies.

Such an ear pad brings it about that in principle one does indeed obtain an open earphone, but without having to accept the disadvantage thereof. Not only can the above described near effect be eliminated to a large extent with the new ear pad, but independently of the height of the ear pad the frequency response of an earphone with the new ear pad can be expanded substantially toward the low frequencies, say down to 10 Hz. This is attributable to the arrangement of at least one vibrating passive membrane with low-pitched natural resonance in the sound path leading through the ear pad out of the coupling space into the open. The membrane, in fact, prevents in the low frequency range, below its natural resonance, the acoustic shortcircuit in the soundpath between the front and back of the transducer diaphragm, together with other accoustic components. Above the natural frequency of the membrane, in, or on, the ear pad, the influence thereof can be neglected, as will be shown later.

With the new ear pad the near effect can be largely compensated by making it so high that the spacing between the sound-emitting transducer diaphragm and the auditory canal is between 3 and 5 cm. at least. If one foregoes an extensive elimination of the near effect, the aforesaid spacing, i.e. the height of the ear pad, may be less, for instance about 2 cm., with a distinct improvement being still noticeable.

It has been found to be especially advantageous to form the membrane as a thin, low-mass foil, having a thickness of about 3 to 20 microns and 500 HZ.

As is evident from the above described definition of the invention, the goal of the invention can be reached if a passive membrane is disposed only on the inner or outer side of a foam body which limits the coupling space and which is preferably approximately annular. This is the simplest, least expensive design form, however, it must be borne in mind that such an externally or internally open membrane can be damaged easily, for which reason it is proposed to protect it against mechanical damage at least by a sound-permeable textile application.

The passive membrane is accommodated much more safely if it is placed inside the foam body forming the ear pad. In that case, the ear pad comprises two concentric foam rings, between which the likewise annular membrane is inserted. The term "rings" or "annular" must here be understood in the widest sense and means only that closed shapes are involved.

To allow the membrane a sufficient vibration amplitude or to bring about a certain natural resonance and attenuation, it is advantageous to provide, in those areas of the foam rings forming the pad which are in contact with the membrane, recesses e.g. in the form of half-cylindrical grooves or trough-like depressions, or to take similar measures which divide each passive membrane into cohering partial membranes.

A further embodiment of the invention is characterized in that the membrane is cut out of a foam material with large closed cells in the form of a thin layer, only one wall remaining of the cells. An advantage of this design may be cited in that a membrane thus made is mechanically very resistant and the remaining edge piece of each cell, which protrudes from the plane of the cell walls that are left, can serve as supporting elements, so that, if desired, recesses in the abutting foam surfaces can be dispensed with.

In principle, it is to be said that the desired effect can be achieved with all those means that can be represented in a form having diaphragm properties, that is, vibration ability and natural resonance, the resonance frequency to be preferably in the range of between 200 and 500 HZ. In order not to disturb the frequency response of the earphone by the natural resonance of the membrane, provision must be made for a sufficient attenuation of the membrane provided in or at the ear pad. As has been indicated above, such an attenuation can be achieved by the selection of the membrane material alone. Other possibilities result e.g. from the use of a plastic foil attenuated with soybean oil or by utilization of the low ohmic resistance of the open-cell foam material in contact with the membrane.

Alternatively, the ear pad may be wedge-shaped, an average distance between auditory canal and transducer diaphragm of about 2 to 5 cm being provided. Such a design is accoustically advantageous, as the transducer diaphragm lies, in use, obliquely to the auricle and this can bring its acoustic properties fully into play.

To avoid that, at the end faces of the ear pad are made impermeable to sound; this can be achieved, for example, by applying a foil, or the like, corresponding to the shape of the ear pad, by gluing or welding. If desired, a membrane placed in or at the ear pad can be used for this purpose, by letting it project at first on both sides of the open-cell foam pad and laying it over at the end faces in a further step.

Accordingly, it is an object of the invention to provide an improved ear pad for earphones which is adapted to embrace a user's ear, and which comprises a tubularly-shaped open-cell elastic foam material, having an interior and an exterior side with at least one passive membrane arranged on at least one of the interior or exterior sides, or between these sides within the material so as to be supported for vibration with a natural resonance which lies in the range of the lower frequencies.

A further object of the invention is to provide an ear pad which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 an elevational view of the interior of an ear pad for a headset constructed in accordance with the invention;

FIG. 2 is a section taken along the line 2—2 of FIG. 1;

FIG. 9 is a longitudinal sectional view through the pad of FIG. 1 provided to explain the equivalent circuit diagram shown in FIG. 10;

And FIG. 10 is a circuit diagram of the electrical acoustic considerations of the device shown in FIG. 9.

GENERAL DESCRIPTION OF THE PREFERRED EMBODIMENT

Figure 3:
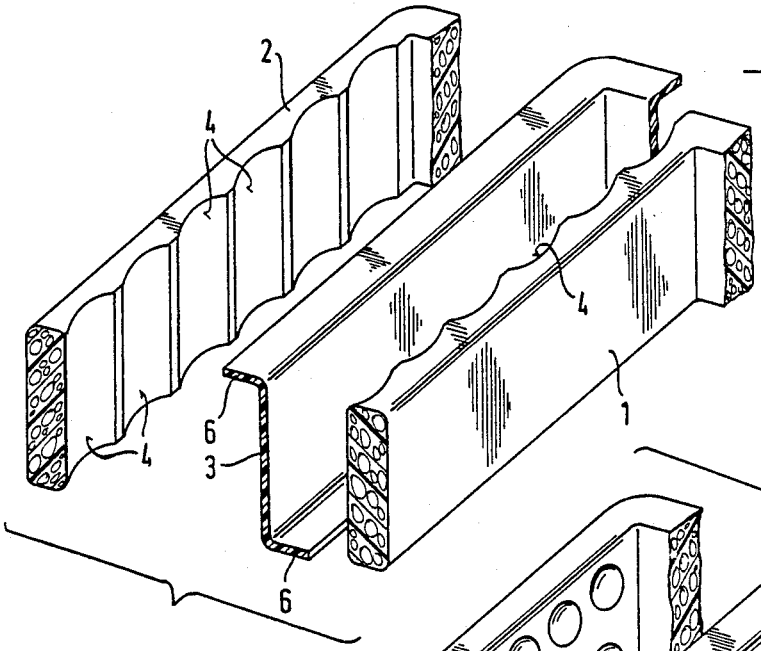
FIG. 3 an exploded perspective view of an embodiment of the wall formation which may be used in the construction of FIGS. 1 and 2.
Figure 8:
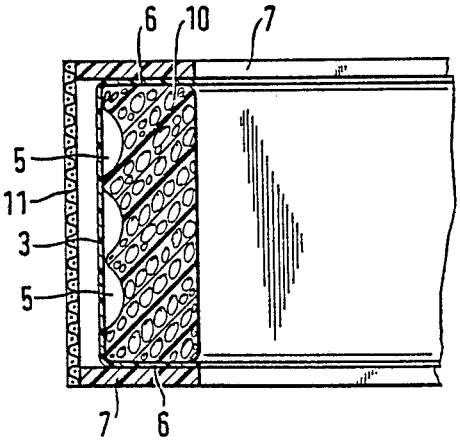
FIG. 8 is a schematic partial section similar to FIG. 2 of another embodiment of the invention.

Referring to the drawings in particular, the invention embodied therein comprises an ear pad generally designated 50 for earphones, which is used to embrace the user's ear and comprises a generally tubular construction, which in accordance with the invention is made with an open-cell elastic foam material, which in the embodiment comprises two rings or annular members 1 and 2 with an intermediate layer or member 3 in the form of a diaphragm or membrane there between.

the outward form of the ear pad 50 is rectangular in the FIG. 1 embodiment. Alternatively it may have any other suitable shape, e.g. round or oval, annular or closed bodies or rings of soft, elastic, open-cell foam material. 1 and 2 are used for the pad 50. A membrane 3, symbolized by a dotted line, lies between the two foam rings 1 and 2. According to the invention, the passive membrane 3 made of plastic foil may alternatively be arranged on either or both the outer and/or inner sides of a single foam ring 10 (FIG. 8) of open-cell foam. As has been stated before, in this case it is protected by a textile covering 11 which offers no substantial resistance to the passage of sound. FIG. 2 shows the same arrangement as FIG. 1, but as a section along a plane in which lies the longitudinal axis of the ear pad.

Figure 4:
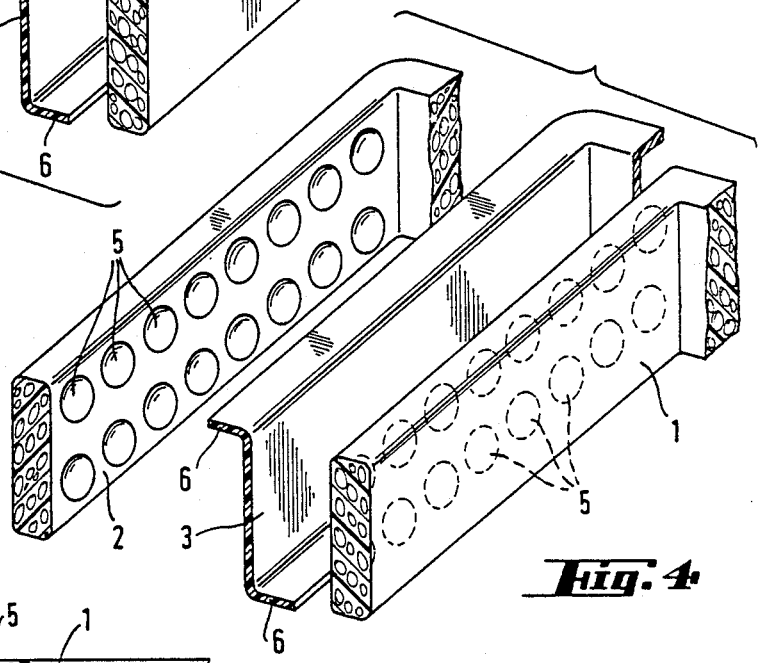
FIG. 4 is a similar view of another embodiment of the invention.
Figure 5:
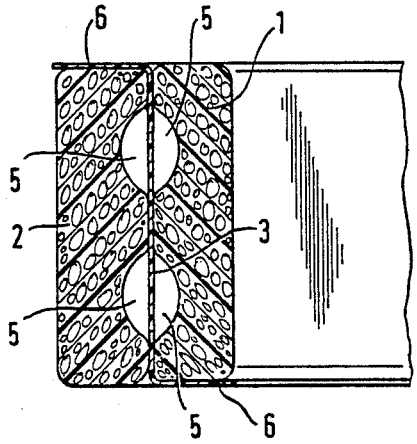
FIG. 5 is a sectional view of an ear pad constructed according to the embodiment of FIG. 4.

To give the passive membrane 3 those vibration properties which are required to bring about the desired effect, it is advantageous to support it, not over its entire surface, but only partially, so that there result cohering partial membranes. Examples of this are illustrated in FIGS. 3 and 4. In FIG. 3, half-cylindrical recesses 4, extend parallel to the longitudinal axis are formed in the two foam rings 1 and 2 enclosing the membrane, whereas in FIG. 4, trough-like depressions 5 are provided. Naturally, other measures may be provided for the formation of partial membranes or webs between each recess in or on the two foam rings 1 and 2 or 10. To prevent the sound from coming out of the coupling space of the earphone at the end-faces of the ear pad by-passing the passive membrane 3, it is necessary to cover the end-faces accordingly. The simplest way is, as shown in FIG. 5, to make the passive membrane 3 wider than the two foam rings 1 and 2, and to bend the projecting membrane parts 6 simply over an associated end-face, and connecting them to the end-face by heat sealing, welding or gluing. It is expedient to flap one projecting membrane part 6 of each membrane 3 outward on one side and to flap another membrane part 6 projecting on the other end over in an inward opposite direction. The part flapped over inward is then directly contiguous to the housing of the earphone, whereas the part folded over outward will, in use, apply directly against the head of the user. Should such a closing be insufficient acoustically or should it not be provided for any reason, then, as FIG. 2 shows, a cover ring 7 may be applied, if desired additionally, on each end-face of the ear pad.

Figure 6:
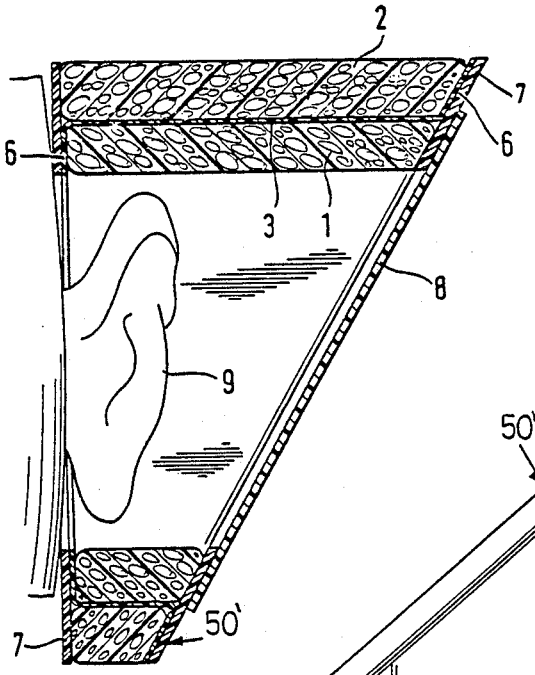
FIG. 6 is a sectional view similar to FIG. 2 of another embodiment of the invention.

The ear pad 50 according to the invention need not necessarily resemble a cylindrical tube piece. It may, as FIG. 6 shows, be wedge-shaped as designated 50', the transducer diaphragm 8 lying obliquely to the plane of the auricle 9.

Figure 7:
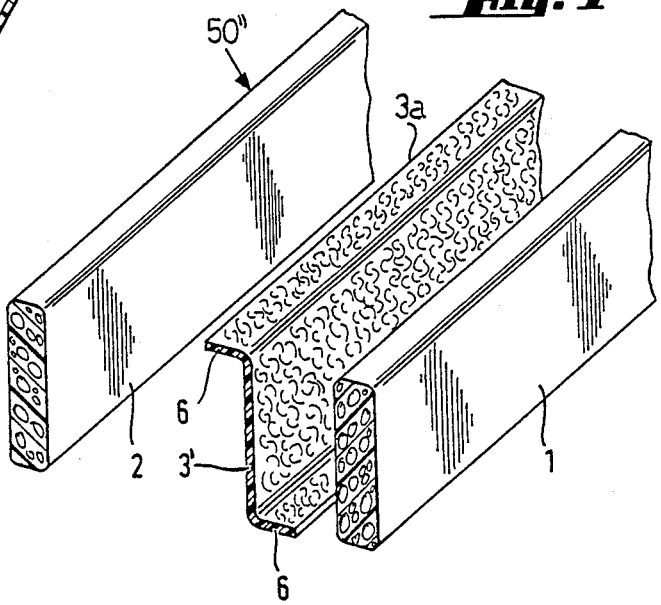
FIG. 7 is a view similar to FIG. 3 of still another embodiment of the invention.

Another variant is shown in FIG. 7 for the pad 50'. In this embodiment the passive membrane 3' is formed, not by a thin, smooth pastic foil, but by a very thin layer which is cut out of a foam material with large, closed cells. In the production of the thin layer 3', the cells are cut open either on one or on the other side of the layer 3', so that there remains of each cell only one wall, which functions as a partial membrane. The edges **3*a* (FIG. 7**) that are left, partially surrounding the wall, space the partial membranes from the respective ring, so that special support elements are not necessary.

To explain the technical effect achieved with the ear pad according to the invention, insofar as it relates to the improvement in reproduction at the lowest audible frequencies, we shall consider the equivalent circuit diagram of the arrangement with the earphone placed on. To this end reference is made to FIG. 9, which is a schematic transverse section through an embodiment where the ear 9 of the user is indicated by a tracing. The opposite side of a coupling space 13 is limited by the active transducer diaphragm 12, which is assumed to be driven either electrostatically or orthodynamically. FIG. 9 shows, besides new and previously used reference symbols, also the symbols for electrical quantities, such as C for capacitance, L for inductance, and R for ohmic resistance. FIG. 10 shows the equivalent circuit diagram developed according to FIG. 9 for the sound path from the active transducer diaphragm 12 through the ear pad into the open. In the equivalent circuit diagram the impedance on the back of the active transducer diaphragm 12 has not been taken into account, this being readily permissible as the back of the active transducer diaphragm 2 is brought out into the open practically without appreciable resistance. In addition, leakage losses between the user's head and the ear pad applying against it in case of use have been regarded as negligible and are therefore not taken into account in the equivalent circuit diagram.

In FIG. 9 and 10, $R_1$, $L_1$ and $C_1$ denote the electrical quantities of the active transducer diaphragm 12 appearing in the eqivalent circuit diagram. C stands for the volume of the coupling space, $R_2$ symbolizes the ohmic acoustic resistance of the inner part 1 of the ear pad, $R_3$ that of the outer part 2. The quantities $R_4$, $L_4$ $C_4$ are correlated with the passive membrane 3. $C_1$ and $C_2$ stand for the volumes 14 and 15 on either side of the passive membrane 3.

Now it can be seen from the equivalent circuit diagram (FIG. 10) that following the series connection $R_1$, $L_1$, $C_1$, symbolizing the active transducer diaphragm 12 there follows the relatively large capacity C of the coupling space 13. In parallel with C there is a voltage divider formed by $R_2$ and $C_1$, which becomes more and more effective with increasing frequency. Expressed in other word, this means that a greater resistance is opposed to the exit of low-frequency sound waves from the coupling space than to those of high frequencies. Following $R_2$ is another frequency-dependent voltage divider, whose one resistor is composed of the magnitudes $R_4$, $L_4$, $C_4$ of the passive membrane 3, and the other, $C_2$, originates from the air volume 14 above the passive membrane 3. The impedance of the series connection of $R_4$, $L_4$,$C_4$ is given by the formula.

$$z = \text{square root of } (R_4^2 + (\text{omega } L_4^2 - 1/\text{omega } C_4)^2).$$

At resonance, Z reaches a minimum. Below the resonance frequency the impedance Z increases rapidly with decreasing frequency, above it with increasing frequency, but only little. This means that the high frequencies of $R_3$, the ohmic resistance of the outer part 2 of the ear pad, can pass into the open with little attenuation, whereas a high resistance is opposed to the low frequencies and forces them to remain in the coupling space. This fact is the explanation for the effect of the ear pad according to the invention in the expansion of the linear frequency response of an earphone down to about 10 Hz.

Obviously, if the invention is to have its full effect, the coupling space must be designed so that no reflections can occur inside it.

What is claimed is:

1. An ear pad for earphones, which pad is adapted to embrace an ear of a user, comprising a generally tubular-shaped formation made of an open-cell, elastic foam material and defining an inner axial opening therethrough for surrounding the ear, and having a generally radially inwardly facing interior side for positioning around the ear and a generally radially outwardly facing exterior side remote from the opening, the formation defining between the interior side and exterior side an internal sound path extending generally radially through said material of the ear pad formation from the interior side to the exterior side, and at least one passive membrane arranged completely across said sound path of the formation and capable of providing a natural resonance which lies in a range of a low frequency, and means on the formation supporting said membrane so that the membrane has such a natural resonance which lies in the range of said low frequency.

2. Pad of claim 1 wherein said membrane is arranged on the interior side of the formation.

3. Pad of claim 1 wherein said membrane is arranged on the exterior side of the formation.

4. Pad of claim 1 wherein said membrane is arranged within the formation between the interior side and exterior side thereof.

5. Pad of claim 1 wherein said membrane comprises a thin, low-mass foil of about 8 to 20 microns thick, having a low frequency natural resonance which lies approximately in a range from 200 to 500 Hz.

6. Pad of claim 1 wherein said foam material formation comprises inner and outer rings arranged one within the other, and said membrane comprises a plastic material which lies between said inner and outer rings.

7. Pad of claim 1 wherein said foam material comprises a plurality of foam rings nested one within the other, at least one of said rings having side recesses in a side face thereof and said membrane is secured to an associated ring between said recesses.

8. Pad of claim 7 wherein the recesses comprise half-cylindrical depressions and said membrane is secured to the associated ring between said depressions.

9. Pad of claim 1 wherein said membrane comprises a foam material of large closed cells forming a thin layer having one surface formed of a wall of closed cells and an opposite surface from which a portion of adjacent closed cells has been cut away to form a wall of partly open cells defining recesses therein, and the membrane is arranged with the wall having the recesses in contact with the formation.

10. Pad of claim 1 wherein said membrane has a greater thickness dimension than said ear pad in the axial direction of the axial opening, and has an edge projecting beyond the ear pad on at least one end thereof which is bent over the end face of said ear pad, and is secured thereto.

11. Pad of claim 1 wherein said foam material formation comprises at least two endless members with said membrane being disposed therebetween, and wherein an outer surface of said members, in a direction crosswise of the axial direction of the axial opening, slopes inwardly to one side.

* * * * *